US009938946B2

(12) United States Patent
Whistler

(10) Patent No.: US 9,938,946 B2
(45) Date of Patent: Apr. 10, 2018

(54) FUEL TURBINE AND THROTTLE BOX

(71) Applicant: Harold J. Whistler, Buckeye, AZ (US)

(72) Inventor: Harold J. Whistler, Buckeye, AZ (US)

( * ) Notice: Subject to any disclaimer, the term of this patent is extended or adjusted under 35 U.S.C. 154(b) by 1003 days.

(21) Appl. No.: 14/269,461

(22) Filed: May 5, 2014

(65) Prior Publication Data

US 2014/0326214 A1 Nov. 6, 2014

Related U.S. Application Data

(60) Provisional application No. 61/819,687, filed on May 6, 2013.

(51) Int. Cl.
*F02M 29/02* (2006.01)
*F02M 59/12* (2006.01)

(52) U.S. Cl.
CPC ..... *F02M 59/12* (2013.01)

(58) Field of Classification Search
CPC ..... F02M 21/045; F02M 29/00; F02M 29/02; F02M 29/04; F02M 59/12
USPC ..... 123/592, 590
See application file for complete search history.

(56) References Cited

U.S. PATENT DOCUMENTS 1,730,410 A * 10/1929 Dennison ..... F02M 7/22 261/50.1
1,796,706 A * 3/1931 Dounce ..... F02M 29/02 48/189.5
1,874,894 A * 8/1932 Calberg ..... F02M 29/02 48/189.5
2,061,043 A * 11/1936 Philip ..... F02M 29/02 165/109.1
2,178,125 A * 10/1939 Scarozza ..... F02M 29/02 48/189.5
2,240,104 A * 4/1941 Uhri, Jr. ..... B01F 5/0451 48/189.4
4,399,880 A * 8/1983 Konishi ..... G01G 19/393 177/1
4,478,607 A * 10/1984 Capps ..... F02M 29/02 123/592
4,537,173 A * 8/1985 Norris ..... F02M 29/02 123/592
5,564,402 A 10/1996 Poschl
5,568,800 A * 10/1996 Einaudi ..... F02M 17/16 123/546
5,860,601 A 1/1999 Egizi
6,209,528 B1 * 4/2001 Kondo ..... F02B 33/40 123/565
6,769,411 B2 * 8/2004 Fabiani ..... F02D 41/0007 123/478

(Continued)

*Primary Examiner* — Hung Q Nguyen
(74) *Attorney, Agent, or Firm* — Venjuris P.C.; Michael F. Campillo

(57) ABSTRACT

A fuel turbine and a throttle body in a fuel system for an internal combustion engine. The fuel turbine includes a fuel turbine housing. The at least one fuel turbine output port is oriented substantially parallel to the fuel turbine housing axis and coupled to the throttle body. A primary fan capable of circumferential rotation and a secondary fan adapted for opposite circumferential rotation are oriented substantially parallel to the fuel turbine housing axis such that atomized fuel enters the fuel turbine input port to be forced by the primary fan and secondary fan into a higher pressure condition before exiting the fuel turbine housing by the at least one fuel turbine output port.

19 Claims, 8 Drawing Sheets

(56) References Cited

U.S. PATENT DOCUMENTS

| | | | | |
|---|---|---|---|---|
| 7,107,974 | B2 * | 9/2006 | Yang | F02B 21/00<br>123/542 |
| 7,261,094 | B2 | 8/2007 | Gurin | |

* cited by examiner

FUEL TURBINE AND THROTTLE BOX

CROSS-REFERENCE TO RELATED APPLICATION

This application claims the benefit of U.S. Provisional Application No. 61/819,687, filed May 6, 2013.

BACKGROUND OF THE INVENTION

Field of the Invention

The present invention relates to fuels systems for internal combustion engines and particularly to a device to improve the fuel system efficiency. More particularly, the invention relates to an induction system and, more particularly, to fuel induction system offering motorists improved fuel efficiency and engine performance while reducing pollutant emissions.

SUMMARY OF THE INVENTION

The invention combines a fuel turbine and a throttle body in a fuel system for an internal combustion engine. The fuel system generally includes a fuel turbine and throttle body wherein the fuel turbine includes a fuel turbine housing having a fuel turbine housing axis and at least one fuel turbine input port and at least one fuel turbine output port. The at least one fuel turbine input port is coupled to the at least one fuel injector output port and oriented substantially parallel to the fuel turbine housing axis. The at least one fuel turbine output port is oriented substantially parallel to the fuel turbine housing axis and coupled to the throttle body. A primary fan capable of circumferential rotation around a primary fan axis is oriented substantially parallel to the fuel turbine housing axis and a secondary fan adapted for opposite circumferential rotation around a secondary fan axis is oriented substantially parallel to the fuel turbine housing axis. Atomized fuel enters the fuel turbine input port to be forced by the primary fan and secondary fan into a higher pressure condition before exiting the fuel turbine housing by the at least one fuel turbine output port.

Alternate embodiments feature one or more preferences including preferred positioning of the at least one fuel turbine input port and the at least one fuel turbine output port on opposite sides of the fuel turbine housing with each oriented substantially parallel to the primary fan axis and the secondary fan axis. Overlapping, covering, nesting, or stacking the positioning of the primary fan axis and the secondary fan. Including a screen nested or adjacently nesting a screen between the primary fan and secondary fan upon which fuel emulsion occurs.

A throttle body is included with the fuel system of the invention and generally includes a valve. A preferred valve comprises a curved body, such as a substantially ball-shaped body, that has at least two radiuses mounted on a pivot in a portion of the throttle body and wherein the curved body has a substantially complementary shape and dimension of a constriction of an inner wall of the throttle body, and such that rotational movement of the pivot rotates the curved body in an arc and moves the surface of curved body towards the constriction in the throttle body to restrict or deter fuel flow in the throttle body and opposite rotational movement of the pivot moves the surface of the curved body in an arc away from the constriction of inner wall of the throttle body and permits or allows relatively more fuel flow.

Preferred embodiments of the throttle body feature an inner wall of the throttle body resembling an hour-glass.

Moreover, the preferred ball-shape valve is preferably rotated by at least one, but preferably two, throttle arms that translate longitudinal movement outside of the throttle body to rotational movement of the pivot on which the ball shape valve is mounted.

Additional aspects include a method of improving fuel flow in an internal combustion engine by providing atomized fuel to a fuel turbine housing through at least one fuel turbine input port and then concentrating the atomized fuel into at least one fuel path within the fuel turbine housing by rotating a primary fan in a first direction around a primary fan axis within the fuel turbine housing to create a first pressure gradient, rotating a secondary fan in the opposite direction around a secondary fan axis within the fuel turbine housing to create a second pressure gradient; and expelling the atomized fuel from the fuel turbine housing through at least one fuel turbine output port

DESCRIPTION OF THE EMBODIMENTS

The Fuel Turbine

Figure 1:
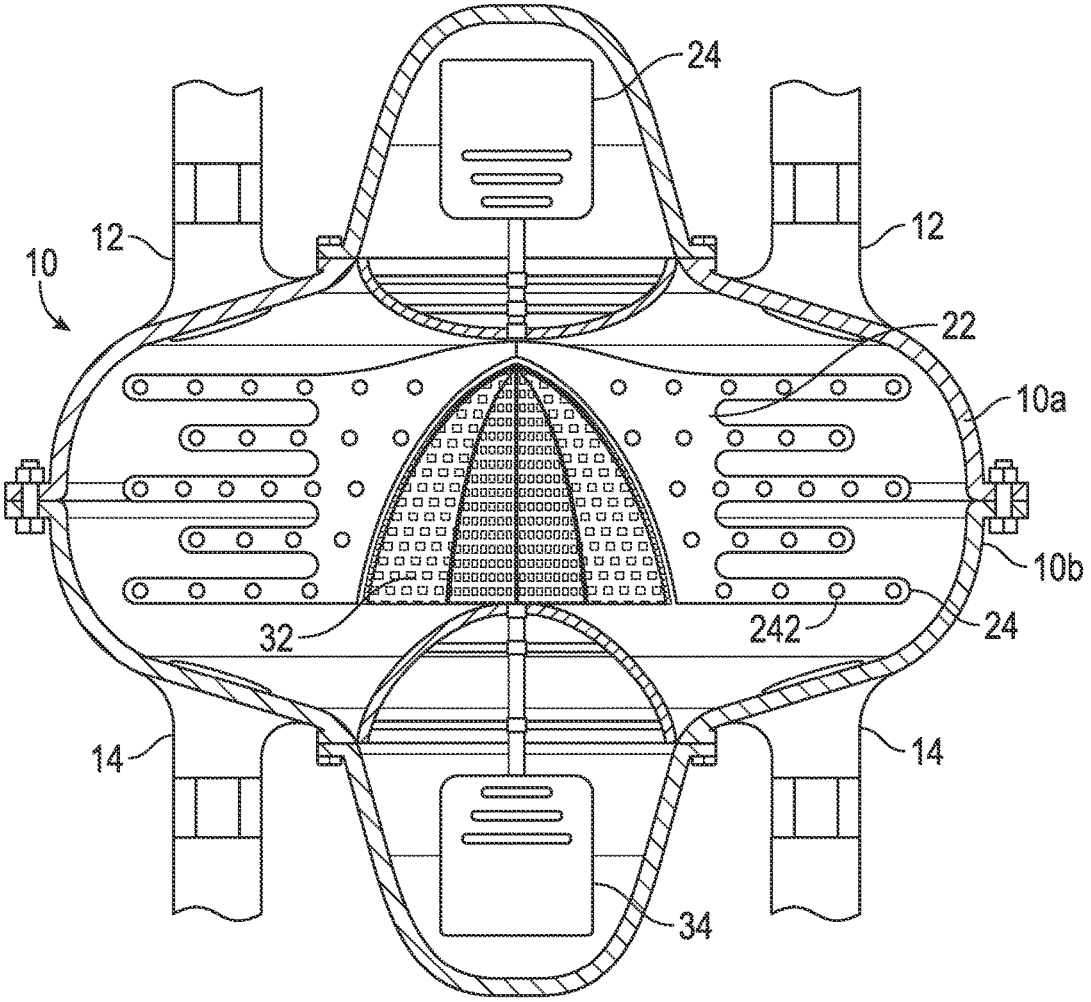
FIG. 1 illustrates a cross-section of a preferred embodiment of the fuel turbine components.

The fuel injector feeds fuel into the fuel turbine housing 10 though the fuel injector output port and is preferably atomized, vaporized, or aerosolized prior to the fuel turbine housing 10. In a preferred embodiment, a direct fuel injection blower forces atomized fuel though the at least one fuel turbine input port 12 into the fuel turbine housing 10. Fuel entering the fuel turbine housing 10 encounters the forces or currents created by the rotating primary fan 20 and the oppositely rotating secondary fan 30 before being expelled from the fuel turbine housing 10 though the at least one fuel turbine output port 14. Moreover, preferred embodiments include at least four fuel turbine input ports 14 distributed or spaced equally in the fuel turbine housing 10 to promote fuel distribution, and preferably substantially even or equal distribution, of fuel into the fuel turbine housing 10. Further, as illustrated in FIG. 1, the fuel turbine input ports 12 are preferably distributed or spaced equally in one-half the fuel turbine housing 10, with an equal number of fuel turbine input ports 12 existing in each quadrant of one-half of the fuel turbine housing 10. Moreover, the fuel turbine input ports 12 are preferably oriented to introduce atomized fuel flow into the fuel turbine housing 10 oriented substantially parallel to each other and substantially parallel to the primary fan axis of rotation 202 and the secondary fan axis of rotation 302. Accordingly the fuel turbine input ports 12 comprise an input port inner surface oriented substantially parallel to the primary fan axis 202 and the secondary fan axis 302. Similarly, while not necessary, preferred embodiments include an equal number of fuel turbine output ports 14 to fuel turbine input ports 12 also distributed or spaced equally in the fuel turbine housing 10 to promote distributed fuel outflow and preferably substantially even or equal outflow of fuel from the fuel turbine housing 10. Again, as illustrated in FIG. 1, the fuel turbine output ports 14 are preferably distributed or spaced equally in one-half the fuel turbine housing 10, with the same quantity of fuel turbine output ports 14 in each quadrant of one-half the fuel turbine housing 10. The fuel turbine output ports 14 are also preferably oriented substantially parallel relative to the primary fan axis 202 and the secondary fan axis 302 so that pressurized or affected fuel exits the fuel turbine housing 10 substantially parallel to the primary fan axis 202 and the secondary fan axis 302. Accordingly the fuel turbine output ports 14 comprise an output port inner surface oriented substantially parallel to the primary fan axis 202 and the secondary fan axis 302.

The fuel turbine housing 10 can be any shape that accommodates the components within including the primary fan 20 and the secondary fan 30 and the related components necessary to allow the fans to create forces to create directed atomized fuel flow in the fuel turbine housing 10. In the illustrated embodiment the fuel turbine housing 10 comprises a first half 10*a* and second half 10*b* wherein each half comprises a composite of a smaller bell-shaped contour that transitions into a larger bell-shaped contour. The first half and second half of the fuel turbine housing 10 join or are detachably connectable together with one or more bolts or any fastener capable of being loosened and tightened to securely joint the halves of a multiple piece housing.

Figure 4:
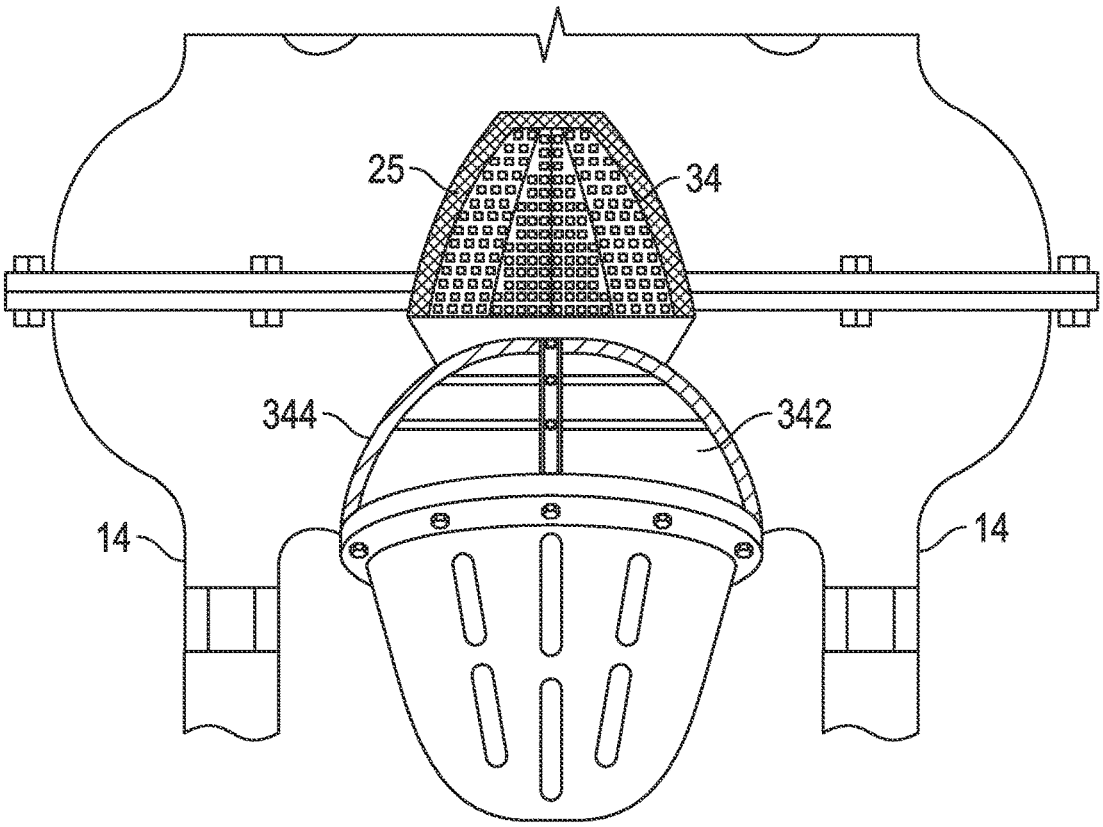
FIG. 4 illustrates the secondary fan 30, the secondary fan motor housing, 341, and the secondary fan motor shaft 342.

The primary fan 20 and the secondary fan 30 are positioned adjacently and rotate in opposite directions and impose forces on the atomized fuel in the fuel turbine housing 10. The kinetic energies of the primary fan 20 and the secondary fan 30 increase the speed of atomized fuel in the housing 10 and increase the pressure of atomized fuel in the system. Moreover, an emulsion screen 25 is positioned between the primary fan 20 and secondary fan 30 and provides a surface upon which atomized fuel emulsion occurs. The screen 25 is preferably mounted to and extends from the secondary fan motor shaft barrier 344 that extends upward and from around the secondary fan motor shaft 342. See FIG. 4.

In one embodiment, the primary fan 20 comprises a partially cone-shaped primary fan surface 22 rotating about the primary fan axis of rotation 202 and has one or more passages, slits, gaps, ports, holes or perforations that permit passage of atomized fuel flow through the primary fan surface 22. The cone-shaped surface is preferably obtusely-angled relative to the direction of fuel flow from the fuel turbine input ports 12 and the preferred angle of the primary fan surface 22 relative to the primary fan axis or alternatively, the direction of fuel flow from the fuel turbine input ports 12, is an obtuse angle of between about five degrees (175°) and one-hundred thirty five degrees (135°).

Figure 3:
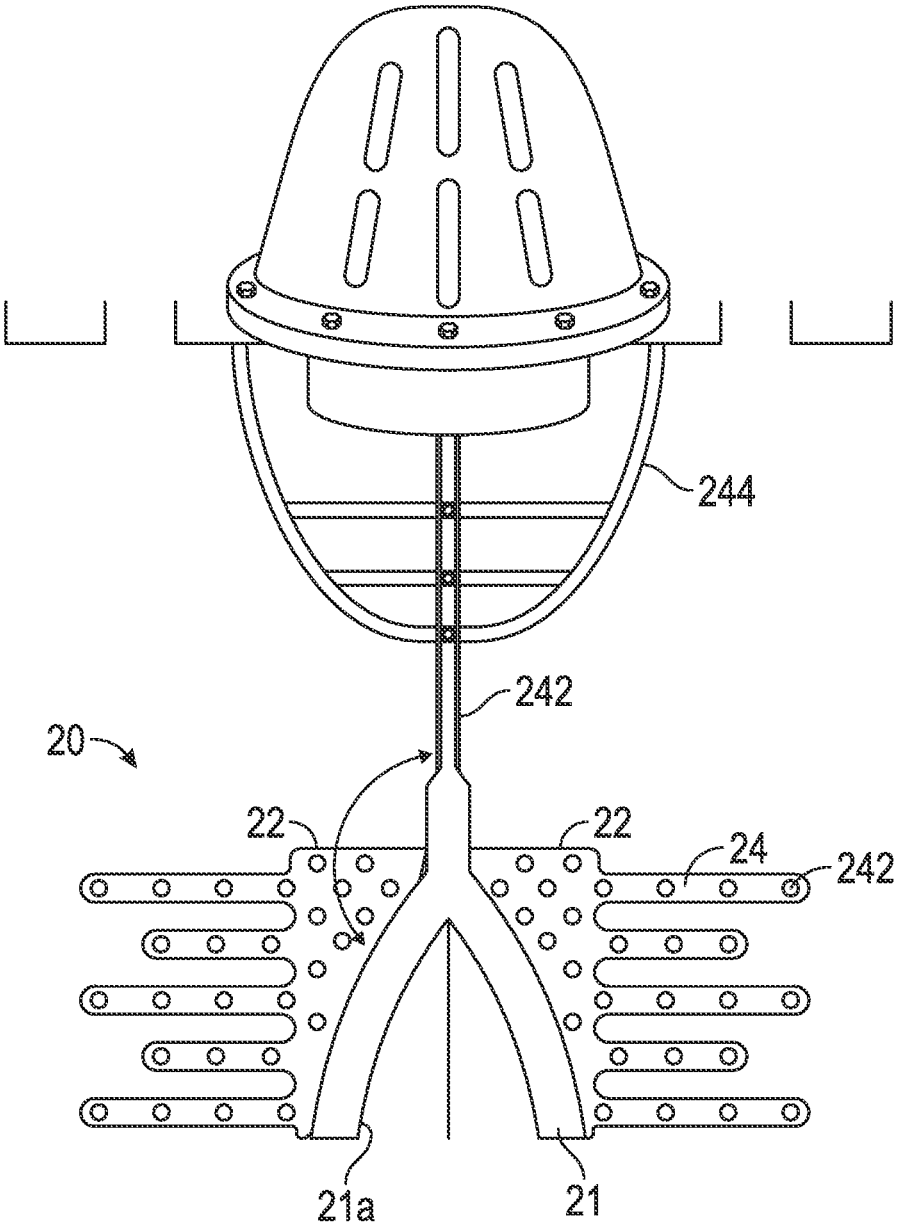
FIG. 3 illustrates the primary fan 20, primary fan motor shaft 242, at least one primary fan paddle 24, and a primary fan aperture 242.

In a second and preferred embodiment, the primary fan 20 comprises an open-ended centrifugal fan with a plurality of fan blades 21 each extending away from a distal end of the primary fan motor shaft 242, which primary fan motor shaft 242 extends from a sealed primary fan motor barrier 244. The plurality of fan blades 21 extend or curve away and partially parallel to the primary fan axis as illustrated in FIG. 3. The plurality of fan blades 21 each have inner fan blade edge 21*a* positioned away from the primary fan axis thereby creating a primary fan cavity 23 adjacent the plurality of inner fan blade edges 21*a*. The plurality of fan blades 21 each extend away from the primary fan motor shaft 242 in a curved fashion by may also extend at a right angle or an obtuse angle provided that a portion of each of the plurality of fan blades 21 each have inner fan blade edge 21*a* positioned away from the primary fan axis thereby creating a primary fan cavity 23 adjacent the plurality of inner fan blade edges 21*a*.

In a first embodiment, the secondary fan 30 also comprises partially cone-shaped perforated secondary fan surface 32 rotating about the secondary fan axis of rotation 302 and includes one or more resistive edges such as ridges, bumps, grooves, or perforations on the secondary fan surface 32 that are oriented to augment forces created by the rotating secondary fan surface 32. Alternatively, the resistive edges instead comprise slits, gaps, ports, holes or perforations to permit atomized fuel to flow through the perforated secondary fan surface 32. Alternatively, preferred embodiments of the secondary fan 30 include a plurality of secondary fan paddles 34 extending from the secondary fan shaft 342 to a plurality of outer fan edges having a substantially cone-shaped two-dimensional projection with curvature. See FIG. 4. The surface secondary fan surface 32 or the two-dimensional projection of the secondary fan paddles 34 are preferably obtusely-angled relative to the direction of fuel flow from the fuel turbine input ports 12. The partially cone-shaped primary and secondary fan surfaces, 22 and 32 respectively, do not have to be true cones with straight edges and can be bowl, cup, or thimble shaped surfaces provided that the surfaces can rotate within the fuel turbine housing 10 and increase pressure upon the atomized fuel in the fuel turbine housing 10.

The preferred partially cone-shaped primary fan surface 22 and partially cone-shaped secondary fan surface 32 are adjacently positioned or overlap within the fuel turbine housing 10. In preferred embodiments, the partially cone-shaped surfaces, 22 and 32, are at least party nested; and as illustrated in the embodiment of FIG. 1, the secondary fan surface 32 is preferably substantially or completely nested inside the partially cone-shaped primary fan surface 22. The primary fan 20 may also include at least one primary fan blades or paddles or as illustrated in the embodiment, a plurality of primary fan paddles 24 extending substantially perpendicularly away from the primary fan surface 22 and into the fuel turbine housing 10. Moreover, the primary fan paddles 24 may each have dimensions equal to other paddles 24 or have at least one alternately dimensioned paddle 24 as illustrated in FIG. 1. Finally, the fan paddles 24 preferably include fan apertures 242 or holes having edges oriented substantially perpendicularly to the direction of fuel flow out of the at least one fuel turbine input port 12 and the at least one fuel turbine output port 14.

The primary fan 20 and the secondary fan 30 are oppositely rotated by a primary fan motor 24 and a secondary fan motor 34, each mounted to opposite sides within the fuel turbine housing 10. The primary fan motor 24 is mounted to the fuel turbine housing 10 and has a primary fan motor shaft 242 that extends into the fuel turbine housing 10 through a motor housing and aperture having sealed motor bearings to prevent the escape of fuel or entry of air into the fuel turbine housing 10. See FIG. 3. The primary fan motor shaft 242 preferably comprises a shaft having a first diameter and a second relatively larger diameter motor shaft before terminating or transitioning to the primary fan 20. The secondary fan motor 34 is mounted to the fuel turbine housing 10 preferably opposite from the primary fan motor 24 and has a secondary fan motor shaft 342 that extends into the fuel turbine housing 10 through a motor housing and aperture having sealed motor bearings to prevent the escape of fuel or entry of air into the fuel turbine housing 10. The secondary fan motor shaft 342 may also comprise a shaft having a first diameter and a second relatively larger diameter motor shaft before terminating or transitioning to the secondary fan 30. A ground conductor 60 connects the fuel turbine housing 10 to engine ground to prevent the buildup of static charge.

Figure 2:
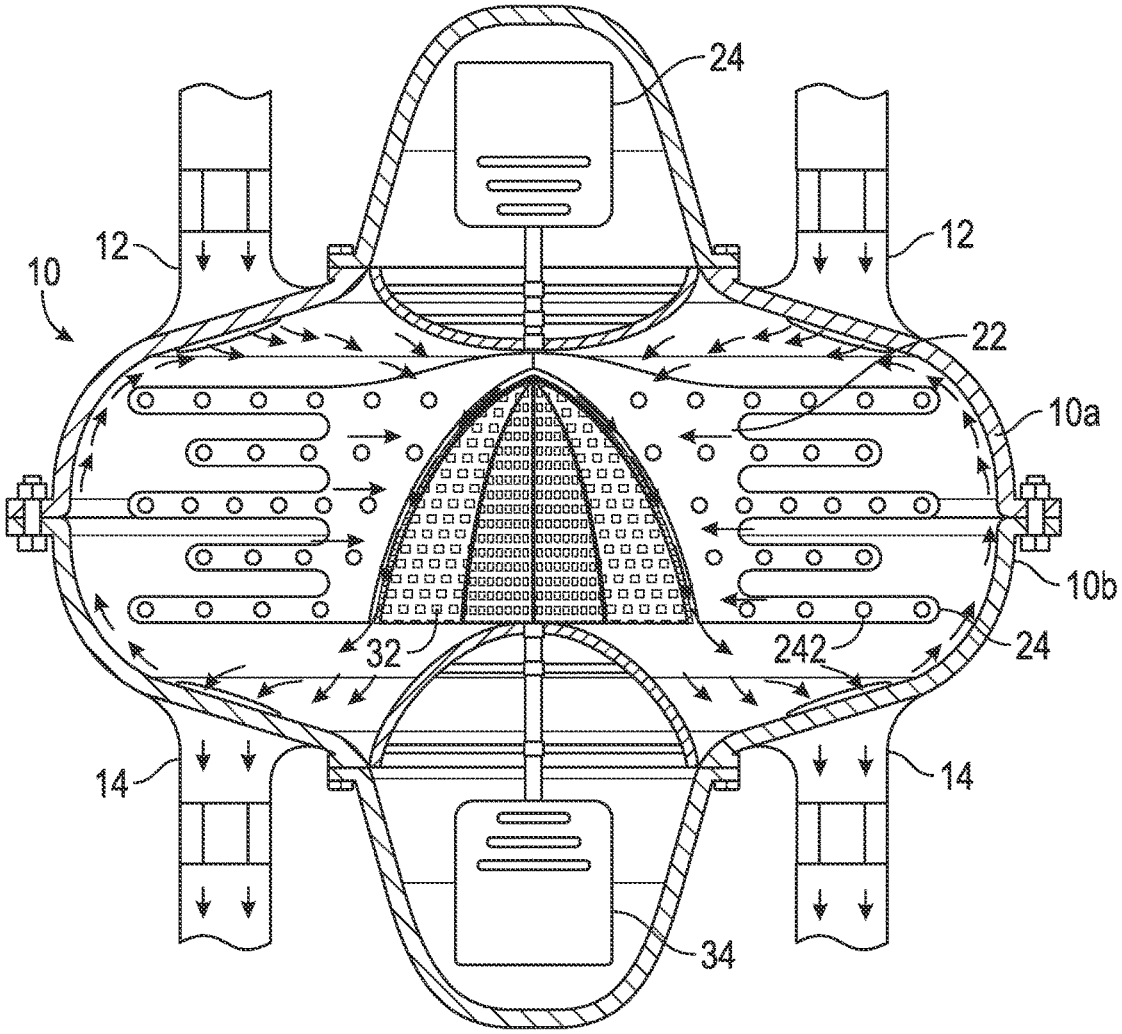
FIG. 2 illustrates a atomized fuel flow within the fuel turbine.
Figure 5:
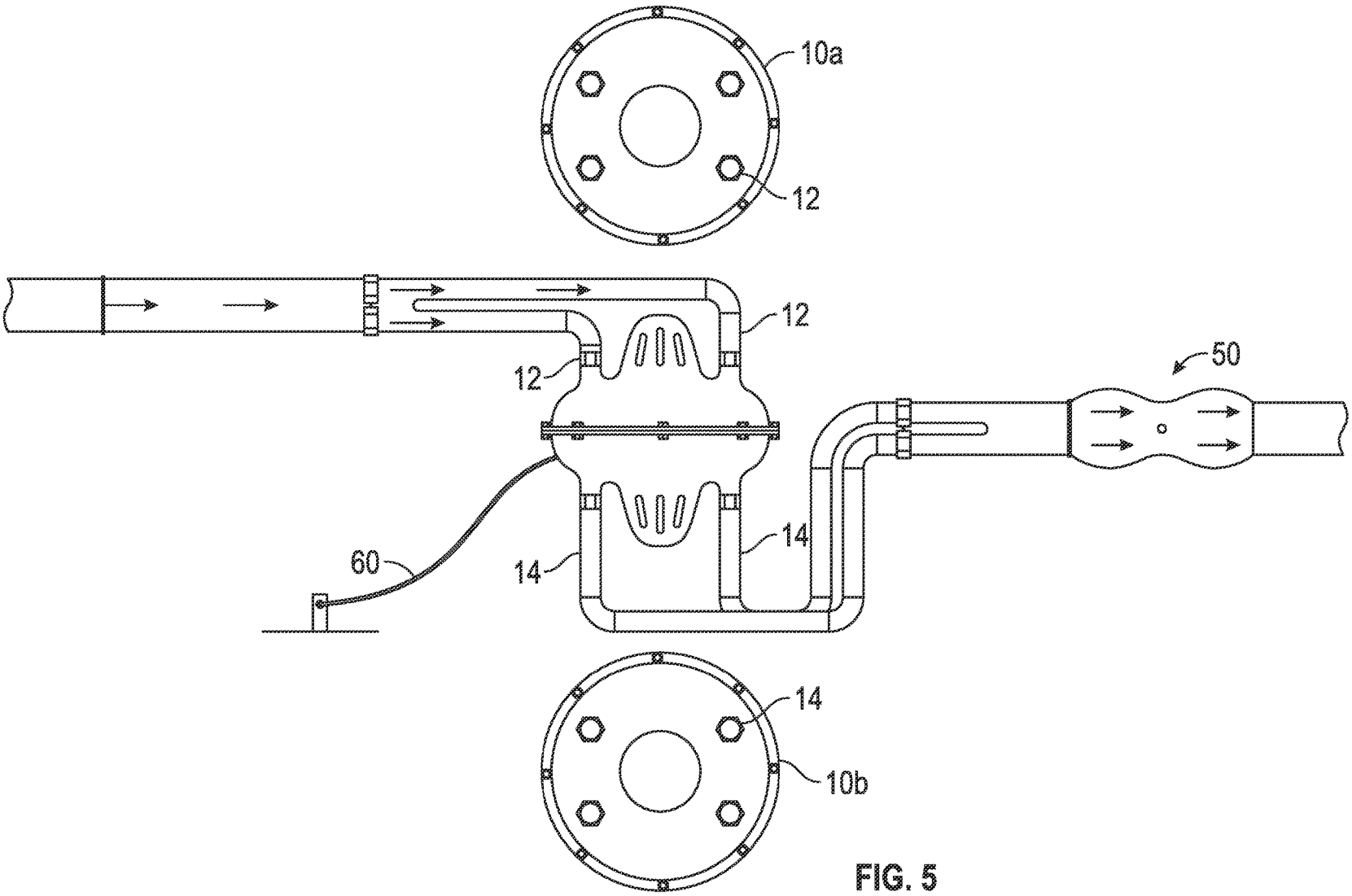
FIG. 5 illustrates the fuel flow through and the fuel turbine 1, a ground conductor 60; and the halves of the fuel turbine housing 10*a* and 10*b*, the at least one fuel turbine input port 12, the at least one fuel turbine output port 14 coupled to the throttle body 50.
Figure 6:
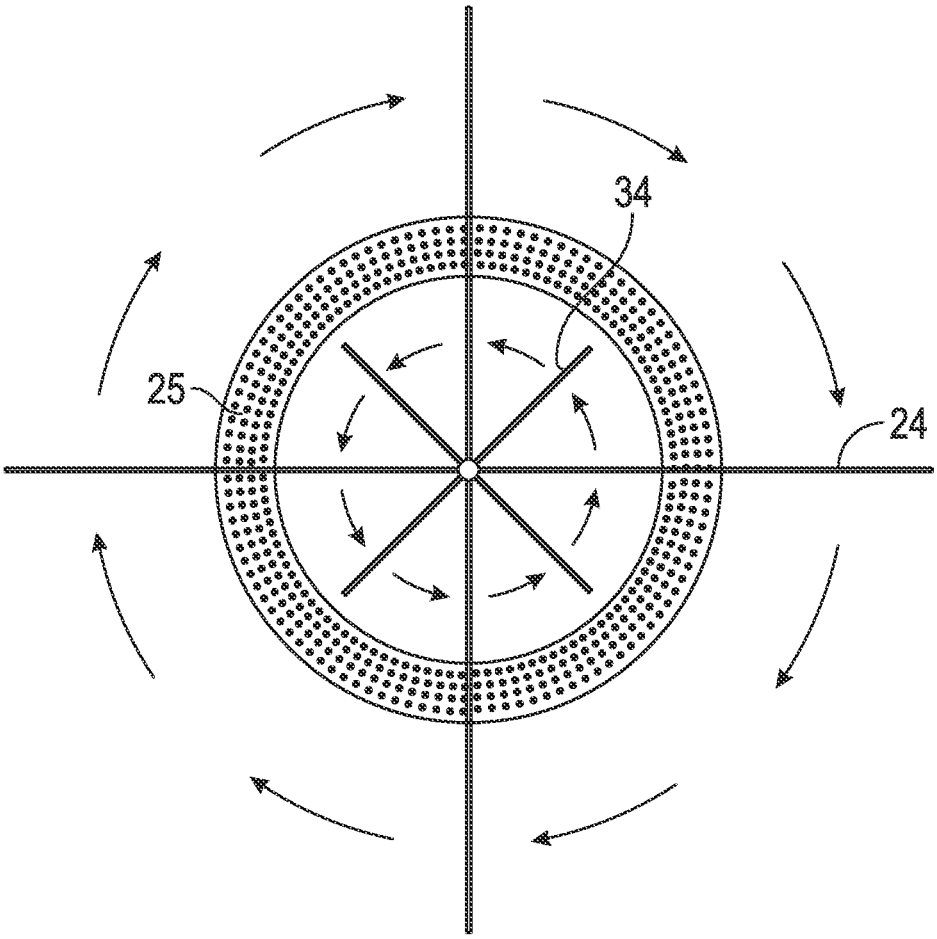
FIG. 6 illustrates a top view of the primary fan 20, the primary fan surface 22, the secondary fan 30, and secondary fan surface 32 and the relative rotation of each, and the screen 25 between the fans that provides a surface upon which fuel emulsion occurs.

The primary fan surface 22 is preferably positioned at least partially adjacent the secondary fan surface 32 so that a gap exists between the oppositely rotating fan surfaces, 22 and 32. See FIG. 6. The preferred gap between the primary fan 20 and secondary fan 30 is about eight thousandths of an inch (0.008 in) while the preferred screen width is about three thousandths of an inch (0.003 in). In the preferred embodiment, the primary fan 20 is rotated in the clockwise direction while the secondary fan 30 is rotated in the counterclockwise direction. Moreover, in the preferred embodiment eight (8) primary fan paddles 24 extend or radiate from an origin at the primary fan axis of rotation. Adjacent and opposite movement of the fan surfaces, 22 and 32, and the angled-shapes of the primary fan 20 and the secondary fan 30 creates a relatively low pressure path between the rotating fan surfaces, 22 and 32 and draws atomized fuel towards the fuel turbine output port 14 as illustrated in FIG. 2. FIG. 5 illustrates atomized fuel flowing from the at least one fuel turbine input port 12 at a first pressure state into the fuel turbine housing 10 and out through the at least one fuel turbine output port 14 at a second higher pressure state to the throttle box 50.

Throttle Body

The throttle body 50 is coupled to the at least one fuel turbine output port 14 and comprises a throttle valve for adjustably regulating the flow of atomized fuel from the fuel turbine. External air, such as from an air filtration system, is introduced and mixed with the pressurized-atomized fuel that exists the throttle body 50. See FIGS. 7*a*-7*d*. The throttle body 50 preferably comprises at least one curved interior throttle body surface 502 against which the throttle valve is adjustably positioned to regulate fuel flow.

FIGS. 7*a*-7*d* illustrate components of a preferred embodiment of the throttle valve and includes. A curved body having a variable radius (i.e. more than one, or at least two effective radiuses), is pivotally secured in the throttle body 50 such that pivoting or rotation of the curved body moves the curved body surface in an arc and to a surface portion having a first radius long enough to position the surface of the curved body against a portion of the throttle body 50 having a constriction 502 comprised of a substantially complementary shape and dimension to the curved body, and pivoting or rotation of the curved body in an arc to a surface portion having a relatively smaller radius moves the surface of the curved body away from the portion of the throttle body 50 having the constriction 502 comprised of a substantially complementary shape and dimension to the curved body. See FIG. 7*a*. As illustrated, the constriction 502 of the inner wall of the throttle body 50 having the substantially complementary shape and dimension to the curved body preferably has dimensions and geometry mirroring or complementing the dimensions and geometry of the curved body such that the curved body surface can be moved against the inner wall of the throttle 50 to deter fuel flow through the throttle body 50.

A preferred curved body comprises a substantially ball-shaped valve 52 having at least two effective radiuses rotatably mounted within the throttle body 50 on at least one pivot 54 extending from the inner wall of the throttle body at the constriction 502. See FIGS. 7*a*-7*c*. Moreover, the substantially ball-shaped valve dimensions and geometry mirror the dimensions and geometry of the preferred constriction 502 i.e. an hour-glass shaped inner wall of the throttle body 50.

Figure 7A:
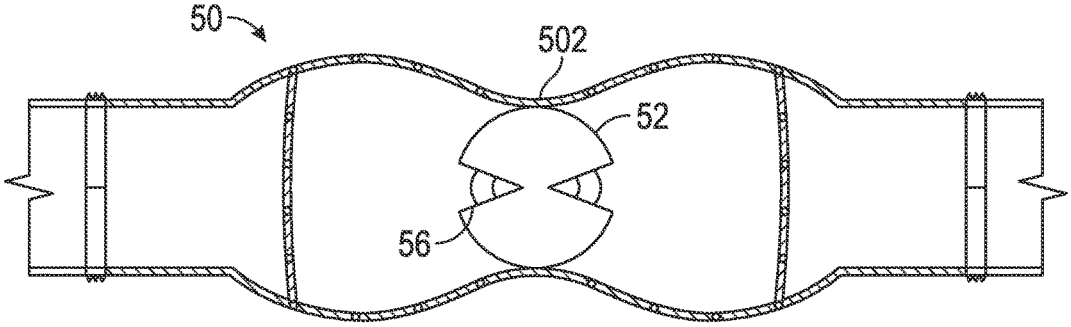
FIG. 7*a* illustrates a preferred embodiment of the throttle body 50 including a ball valve 52 pivotally mounted in a constriction 502 of the throttle body 50 inner wall and illustrating the orientation of the at least one valve groove 56 on the ball valve 52.
Figure 7B:
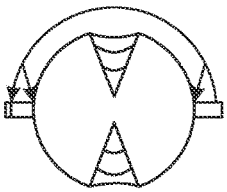
FIG. 7*b* illustrates the ball valve 52 mounted on at least one pivot 54 and having at least one ball valve groove 56 providing at least two effective radiuses.
Figure 7C:
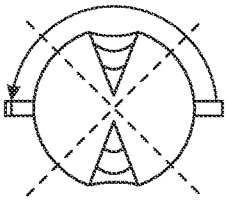
FIG. 7*c* illustrates the ball valve 52 having a ball valve surface with at least two effective radiuses with the relatively larger radius located at the intersection of the dashed lines and the relatively smaller radiuses located at the ball valve grooves 56.
Figure 7D:
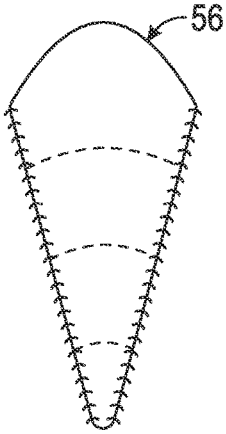
FIG. 7*d* illustrates a preferred cone-shaped valve groove 56 having at least two effective radiuses and more preferably, a cone-shaped valve groove 56 having increasing variable depth as the groove widens.
Figure 7E:
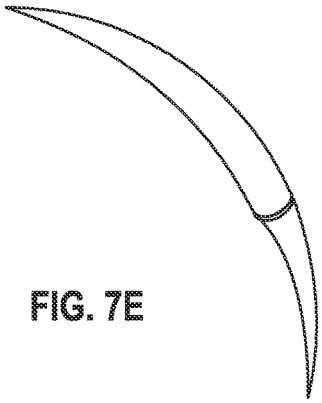
FIG. 7*e* illustrates the preferred shape and dimension of the cone-shaped valve groove 56 having increasing variable depth as the groove widens.
Figure 7F:
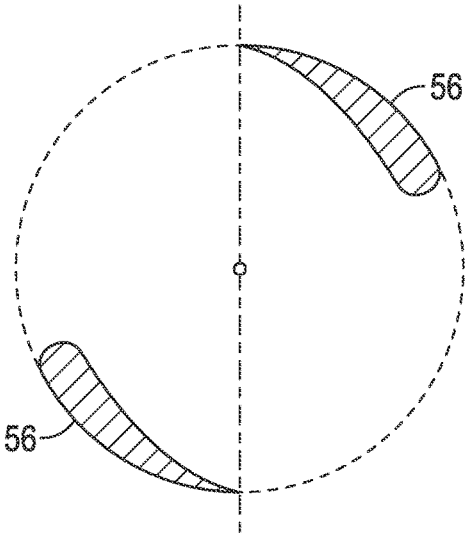
FIG. 7*f* illustrates the preferred positioning of the at least one valve groove 56 on the ball valve 52, the center position of the at least one pivot 54, and the cone-shaped valve groove 56 having increasing variable depth as the groove 56 widens creating a ball valve 52 having variable radius.

One preferred embodiment of the ball-shaped valve 52 enabling at least two effective radiuses includes the use of a valve groove 56 having increasing cross-sectional area in a portion of the surface of the curved body. The preferred valve groove 56 illustrated in FIG. 7*d* resembles a cone-shape from the top view. Moreover, the groove 56 has a smooth curved interior surface that gradually deepens as the cone-shape widens. For example, FIG. 7*e* illustrates a three-dimensional view of the preferred smooth curved varying dimension of a non-bisected groove 56. Note that the illustration is for description purposes and in practice the groove 56 is the inverse or negative of the shape in FIG. 7*e* and is bisected along the length of the groove from pointed tip to pointed tip. FIG. 7*f* illustrates the preferred location of two grooves 56 located on opposite sides of the ball valve 52. The illustrated embodiments include a cone-shaped valve groove 56 having with the relatively narrow end of the cone-shaped groove oriented in the direction of fuel flow in the throttle body 50 and positioned at the constriction 502. Rotation of the ball shaped valve 52 surface to a first position where the relatively narrow end of the cone-shaped groove is positioned at or near the constriction 502 positions the surface of the ball valve 52 at or near the constriction and reduces fuel flow and rotation of the ball shaped valve 52 surface to a second position where the relatively wider end of the cone-shaped groove is positioned at or near the constriction 502 positions less of the ball valve 52 surface at or near the constriction 502 and permits relatively greater fuel flow.

Figure 8A:
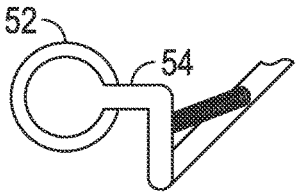
FIG. 8*a* illustrates the throttle arm and ball valve 52.
Figure 8B:
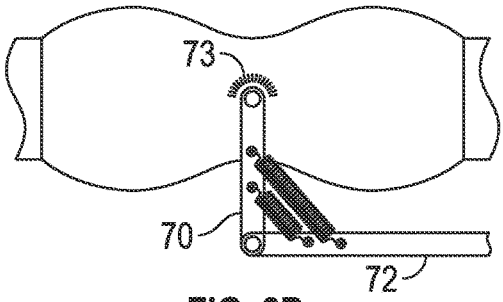
FIGS. 8*b* and 8*c* illustrate the throttle body 50 and preferred hourglass shape, the positioning of the throttle arms 70 and 72, and the at least one pivot 54 upon which the curved body or ball valve 52 is mounted.
Figure 8C:
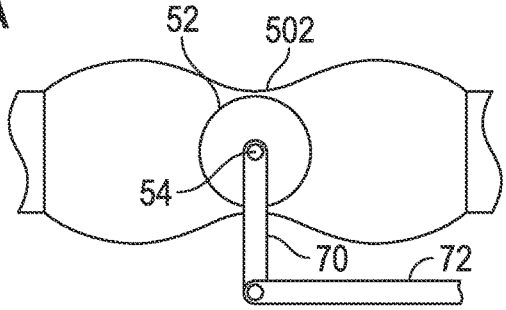
Figure 8D:
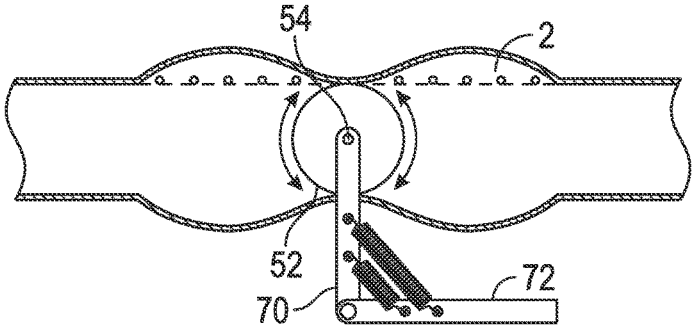
FIG. 8*d* illustrates the pivoting or rotational movement of the ball valve 52 on the at least one pivot 54 positioned at the throttle body constriction 502 to permit fuel flow 2 in the throttle body 50.
Figure 8E:
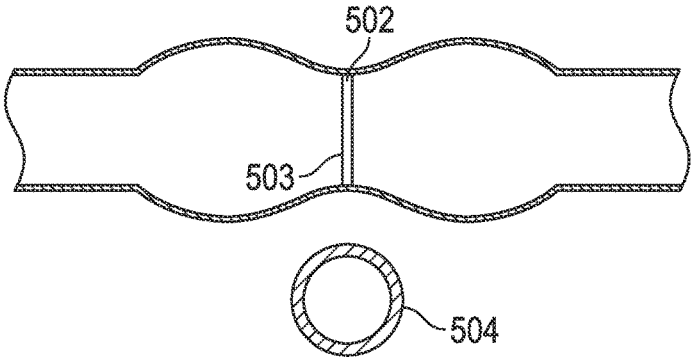
FIG. 8*e* illustrates a groove-ring milled 503 into the throttle body 50 at the throttle body constriction 502 into which a ring-gasket 504 is inserted and against which the ball valve 52 is rotated.

A preferred manner of rotating the curved body comprises securing the at least one pivot 54 to a throttle arm 70. See FIGS. 8*a*-8*d*. In the illustrated embodiment, the throttle arm 70 is secured to the pivot 54 and a second throttle arm 72 is pivotally mounted at a position away from the first end of the throttle arm 70 so that movement of the second end or portion of the throttle arm 70 substantially parallel to the throttle body 50 translates to rotational or pivoting movement of the ball valve 52 inside the throttle body 50. See FIGS. 8*a*-8*c*. Further preferences include having at least one spring connected diagonally between the throttle arms and biasing the throttle arms into a substantially ninety-degree angled position. Moreover, to facilitate sealing the throttle body 50 to deter fuel flow 2, a groove-ring 503 is milled into the throttle body 50 at the constriction 502 and an O-ring or ring-gasket 504 is inserted in the groove-ring 503. See FIG. 8*e*. The surface of the curved body or ball valve 52 is pivoted or rotated to position the ball-valve surface against the O-ring or ring-gasket 504 to create a sealing contact and pivoted or rotated to position the ball-valve surface away from the O-ring or ring-gasket 504 to permit fuel flow.

The induction system of the present invention offers a new and potentially more efficient system of fuels and fuel-injection for internal-combustion engines, in which two or more alternative fuels ere atomized to produce combustion of greater power and efficiency, with a lower volume of environmentally damaging exhaust gases, than is achieved by standard contemporary automotive engines, An internal combust ion engine is any engine that uses the explosive combustion of fuel to push a piston within a cylinder with the piston's movement turns a crankshaft that then turns the car wheels via a chain or a drive shaft. The most common internal combustion engine is gasoline powered. Others varying modifications and alternative embodiments being taught. While the invention has been so shown, described and illustrated, it should be understood by those skilled in the art that equivalent changes in form and detail may be made herein without departing from the true spirit and scope of the invention, and that the scope of the present invention is to be limited only to the claims except as precluded by the prior art. Moreover, the invention as disclosed here in may be suitably practiced in the absence of the specific elements which are disclosed herein.

The invention claimed is:

1. A fuel system for an internal combustion engine, comprising:

a fuel turbine housing having a fuel turbine housing axis and at least one fuel turbine input port and at least one fuel turbine output port, the at least one fuel turbine input port coupled to and oriented substantially parallel to the fuel turbine housing axis, the at least one fuel turbine output port oriented substantially parallel to the fuel turbine housing axis and coupled to a throttle body;

a primary fan adapted for circumferential rotation around a primary fan axis oriented substantially parallel to the fuel turbine housing axis, the primary fan comprising an open-ended centrifugal fan having a plurality of fan blades extending from the primary fan axis;

a secondary fan adapted for opposite circumferential rotation around a secondary fan axis oriented substantially parallel to the fuel turbine housing axis; and a screen positioned between the primary and secondary fans;

wherein the primary and secondary fan and screen each have a cross-sectional shape that is obtusely-angled relative to the direction of fuel flow from the fuel turbine input port and the primary fan, the screen, and the secondary fan are nested together and fuel exits the fuel turbine input port and enters the fuel turbine housing to be forced by the primary fan and secondary fan into a higher pressure condition before exiting the fuel turbine housing by the at least one fuel turbine output port and entering the throttle body.

2. The fuel system in claim 1 wherein, the at least one fuel turbine input port and the at least one fuel turbine output port are positioned on opposite sides of the fuel turbine housing and each is oriented substantially parallel to the primary fan axis and the secondary fan axis.

3. The fuel system in claim 2 wherein, the primary fan is positioned at least partially between the at least one fuel turbine input port and the at least one fuel turbine output port.

4. The fuel system in claim 1 wherein, the cross-sectional shape is selected from cones, bowls, and cups.

5. The fuel system in claim 1 further comprising, the throttle body comprises a throttle valve for adjustably regulating the flow of atomized fuel from the fuel turbine output port.

6. The fuel system in claim 5 wherein, the throttle valve comprises a curved body having a surface positionable in the throttle body towards and away from a substantially complementary shape and dimension of the inner wall of the throttle body.

7. The fuel system in claim 6 wherein, the curved body comprises a substantially ball shaped body.

8. The fuel system in claim 6 wherein, the curved body has at least two effective radiuses and is pivotally secured in the throttle body wherein rotation of the curved body in an arc to a first curved body surface portion having a first radius moves the surface of the curved body substantially near or against the substantially complementary shape to restrict fuel flow, and wherein rotation of the curved body in an arc to a surface portion having a second radius moves the surface of the curved body substantially away from the substantially complementary shape to permit relatively more fuel flow.

9. The fuel system in claim 8 wherein, the curved body is pivotally secured to an inner wall of the throttle body using at least one pivot selected from the group consisting of a peg, nob, rod, boss, or bump extending between the curved body and the inner wall of the throttle body.

10. The fuel system in claim 6 wherein, the substantially complementary shape comprises a hour-glass shaped inner wall of the throttle body.

11. The fuel system in claim 10 wherein, the curved body comprises a ball-shape mounted on at least one pivot extending to an inner wall of the throttle body.

12. The fuel system in claim 1 wherein, the screen is preferably mounted to and extends from a secondary fan motor shaft barrier that extends upward and from around the secondary fan motor shaft.

13. The fuel system in claim 1 wherein, at least one of the primary or secondary fans is open-ended centrifugal fan that includes a plurality of fan blades extending away from at least one of the primary or secondary fan axis.

14. A method of improving fuel flow in an internal combustion engine, comprising:

providing atomized fuel to a fuel turbine housing through at least one fuel turbine input port;

concentrating the atomized fuel into at least one fuel path within the fuel turbine housing by rotating a primary fan in a first direction around a primary fan axis within the fuel turbine housing to create a first pressure gradient, rotating a secondary fan in the opposite direction around a secondary fan axis within the fuel turbine housing to create a second pressure gradient, the primary and secondary fan each have a cross-sectional shape that is obtusely-angled relative to the direction of fuel flow from the fuel turbine input port, and the primary fan and secondary fan are nested within the fuel turbine housing; and expelling the atomized fuel from the fuel turbine housing through at least one fuel turbine output port.

15. The method in claim 14, further comprising:

throttling the fuel flow expelled through the at least one fuel turbine output port by positioning a curved body surface towards or away from a substantially complementary shape and dimension of an inner wall of a throttle body.

16. The method in claim 15, wherein the curved body has at least two effective radiuses and is pivotally secured in the throttle body and the method further comprises:

pivoting the curved body in an arc to a first curved body surface portion having a first radius to move the surface of the curved body substantially near or against the substantially complementary shape to restrict fuel flow, and pivoting of the curved body in an arc to a surface portion having a second radius moves the surface of the curved body substantially away from the substantially complementary shape to permit relatively more fuel flow.

17. The method in claim 15, wherein the curved body has at least two effective radiuses.

18. A fuel system for an internal combustion engine, comprising:

a fuel turbine housing having a fuel turbine housing axis and at least one fuel turbine input port and at least one fuel turbine output port, the at least one fuel turbine input port coupled to and oriented substantially parallel to the fuel turbine housing axis, the at least one fuel turbine output port oriented substantially parallel to the fuel turbine housing axis and coupled to a throttle body;

a primary fan adapted for circumferential rotation around a primary fan axis oriented substantially parallel to the fuel turbine housing axis;

a secondary fan adapted for opposite circumferential rotation around a secondary fan axis oriented substantially parallel to the fuel turbine housing axis;

a screen positioned between the primary and secondary fans;

wherein the primary and secondary fan and screen each have a cross-sectional shape that is obtusely-angled relative to the direction of fuel flow from the fuel turbine input port and the primary fan, the screen, and the secondary fan and screen each comprise an open-ended fan having a cross-sectional shape selected from cones, bells, bowls, cups, or thimbles, and are nested together, and fuel exits the fuel injector output port and enters the fuel turbine housing to be forced by the primary fan and secondary fan into a higher pressure condition before exiting the fuel turbine housing by the at least one fuel turbine output port and entering the throttle body.

19. The fuel system in claim 18 wherein, the open-ended fan comprises a centrifugal fan with a plurality of fan blades extending away from the primary fan axis.

* * * * *